US005806704A

United States Patent [19]

Jamison

[11] Patent Number: 5,806,704

[45] Date of Patent: Sep. 15, 1998

[54] PAINT CONTAINER VACUUM LID

[76] Inventor: Richard W. Jamison, 6132 Ferne Ave., Cypress, Calif. 90630

[21] Appl. No.: 691,331

[22] Filed: Aug. 2, 1996

[51] Int. Cl.[6] ..... B65D 41/16; B65D 51/16

[52] U.S. Cl. ..... 220/212; 206/15.3; 220/231; 220/736; 220/784; 220/792; 220/793; 220/795

[58] Field of Search ..... 220/212, 212.5, 220/203.04, 780, 792.3, 795, 324, 326, 735, 736, 697, 231, 784; 215/228, 262, 311, 390; 206/361, 363, 15.2, 15.3

[56] References Cited

U.S. PATENT DOCUMENTS

| | | | |
|---|---|---|---|
| 4,016,999 | 4/1977 | Denzer . | |
| 4,218,967 | 8/1980 | Batchelor . | |
| 4,388,767 | 6/1983 | Dison et al. . | |
| 5,195,427 | 3/1993 | Germano . | |
| 5,314,061 | 5/1994 | Bedrossian . | |
| 5,328,069 | 7/1994 | Cohanfard | 220/213 X |
| 5,339,981 | 8/1994 | Kral . | |
| 5,405,038 | 4/1995 | Chuang . | |
| 5,499,735 | 3/1996 | Chen . | |

*Primary Examiner*—Allan N. Shoap
*Assistant Examiner*—Niki M. Kopsidas
*Attorney, Agent, or Firm*—Gordon K. Anderson

[57] ABSTRACT

A vacuum lid for a round thermoplastic paint container that includes a domed lid (20) with a valve cavity (22), a circumferential lip (38), and a peripheral flange (40). An O-ring (42) is positioned between the lip and flange to seal the container. A pair of lifting tabs (44) hold the lid onto the container by snapping into place onto the container's top lip (24). A one-piece unitary resilient valve (48) is located in the valve cavity and a vacuum pump (56) is attached to the valve. Air is evacuated from the covered container to prevent drying of the paint and utensils stored inside. The pump, in the manual form, is stored in brackets (66) on the surface of the lid, as well as a roller handle extension (70) retained in like brackets (68) for the convenience. One or more hooks (62) are mounted within the lid to hang wet brushes. The preferred embodiment is for 5 gallon containers, and a second embodiment is utilized with 2½ gallon containers requiring the addition of a rectangular rib (72) in the lid to accommodate the storage of a paint roller (28).

14 Claims, 4 Drawing Sheets

PAINT CONTAINER VACUUM LID

TECHNICAL FIELD

The present invention relates to lids for containers in general. More specifically, to a domed lid for a paint container permitting evacuation of the container for storage.

BACKGROUND ART

Previously, many types of container lids have been used in endeavoring to provide an effective means for producing a partial vacuum within the container itself. Some prior art has built in a valve as part of a lid to which a hand pump may be attached. Others have incorporated an air valve with a pressure relief device. A diaphragm pump has been included as an integral part of the lid to draw a partial vacuum within a container. It appears that most prior art is directed to food containers that employ the principle of removing some of the air within the container to impede oxygenation of the product. The same ultimate results may be utilized in paint pails or buckets to prevent paint from drying. Further, other prior art has attempted to slow the paint drying process by adding antioxidant vapor into a closed container, or placing a sealing device on the liquid surface.

A search of the prior art did not disclose any patents that read directly on the claims of the instant invention, however, the following U.S. patents are considered related:

| U.S. Pat. No. | Inventor | Issue Date |
|---|---|---|
| 5,499,735 | Chen | Mar. 19, 1996 |
| 5,405,038 | Chuang | Apr. 11, 1995 |
| 5,339,981 | Kral | Aug. 23, 1994 |
| 5,314,061 | Bedrossian | May 24, 1994 |
| 5,195,427 | Germano | Mar. 23, 1993 |
| 4,388,767 | Dison et al | Jun. 21, 1983 |
| 4,218,967 | Batchelor | Aug. 26, 1980 |
| 4,016,999 | Denzer | Apr. 12, 1977 |

Chen, in U.S. Pat. No. 5,499,735, teaches a lid for vacuum sealed containers that incorporates a valve that releases air into the container by pressing a knob at the top portion, which releases a ball seated on an O-ring seal.

U.S. Pat. No. 5,405,038, issued to Chuang, is for a complete storage container for food that includes an airtight lid and a pump for evacuation. The container has a ring shaped protrusion in a concave bottom for stacking. The lid contains a vacuum valve with an umbrella-shaped silicon member that seals the vacuum within, but allows attachment of a manual pump.

Kral's U.S. Pat. No. 5,339,981 discloses a circular sealing device that is placed over the top surface of the liquid paint within a can to prevent formation of a skin. The invention incorporates a handle with an integral purge valve with an open position to permit installation, and a closed position for sealing.

U.S. Pat. No. 5,314,061 of Bedrossian is for a set-up that attaches paint implements on the lid for temporary storage of wet rollers and brushes.

Germano, in U.S. Pat. No. 5,195,427, teaches a suction device to create a vacuum in food containers. The device includes an electric motor, transfer gears, and a piston suction pump.

U.S. Pat. No. 4,388,767 is for a process and apparatus wherein a paintbrush is suspended within a covered housing containing an antioxidant with its vapor preventing hardening of the paint on the brush.

A diaphragm pump is incorporated on a cover in U.S. Pat. No. 4,218,967 issued to Batchelor. The cover has an overlaying diaphragm forming a pump chamber and a manual lever axially reciprocates the diaphragm to draw air from the container. A check valve and relief valve are employed within the lid and container.

Denzer's U.S. Pat. No. 4,016,999 is for a lid that includes an integral pump. The lid, or enclosure, includes a vent for relieving pressure within the container and flapper valve for evacuation.

DISCLOSURE OF THE INVENTION

There has been a prolonged problem facing those that frequently apply paint, particularly professional painters, where daily cleaning of equipment requires considerable time and effort, taking away valuable opportunities for productive accomplishment. Many painters use a so-called "set-up" for painting large surfaces, as well as detailed work consisting of a bucket, pail, or container, with a roller grid inside, along with a roller and brush. Paint from the original factory container is poured into the set-up container to a partial level, permitting easy access for the roller or brush.

At the end of the day, if the job is not completed, the set-up must be cleaned, so as to prevent hardening of the paint in the equipment and around the wetted walls of the container. If storage is prolonged, a "skim", or "skin", of hardened paint may actually form on the liquid paint surface. At any rate, it may be visualized that clean-up may take considerable time that is actually wasted if the equipment is to be used the next day. It should be noted that latex paints that have a vehicle of acrylic or polyvinyl resins suspended in water may be cleaned in tap water and, therefore, do not pose as much of a problem as oil based paints, however effort is still required to find running water and locate suitable disposal means.

Oil based paints having a vehicle of vegetable drying oils, such as linseed or soybean oil, are required when initially covering bare wood. This covering, particularly in the prime coat, prevents tannic acid inherent in the wood from bleeding through and leaving streaks in the finished surface. Light colored paints are extremely susceptible to this bleed through phenomena, therefore, oil based primers, at least, are almost exclusively used in covering wood surfaces.

Cleaning this oil based paint equipment becomes a very real and tedious problem, as the equipment must be submerged in a solvent or thinner that dilutes the paint to the extent that it is in solution and then must be wiped dry by hand with rags or paper towels. The cleaning procedure may take as much as 2 quarts (1.9 liters) of solvent per brush, and as long as a half of an hour of labor to clean the set-up. This means that over extended periods of time, hundreds of man-hours are used just for cleaning and, to make matters worse, the solvent cannot be just dumped, as it becomes a hazardous waste and must be disposed of properly, or recycled. In large cities where air pollution is a problem, the solvent is aromatic and vaporizes into the air, adding to the pollutants already present. Sometimes professional painters throw away roller covers after each days work, rather than cleaning them, due to the above problems. In selected areas of the United States, in order to protect the environment, oil based paint is sold only in small quantities, due to its high DOC rating, and stringent laws have been passed relative to its handling.

With this in mind, it is a primary object of the invention to provide a cover for a paint container large enough for a set-up that will allow all of the equipment to be stored inside and prevent drying of the paint for extensive periods of time, precluding daily cleaning. This object is accomplished by utilizing a lid that is domed in shape, preferably elliptical, allowing the bail handle to clear in its upright position, while giving sufficient area inside to house all of the equipment necessary for a set-up. In a 5 gallon embodiment, the elliptical shape is sufficient, however, in a set-up using a 2½ gallon container, a raised rectangular rib is necessary to clear the handle of a paint roller. A valve is mounted in the top of the lid and a vacuum pump is attached permitting a partial vacuum to be pulled inside the container removing air and its accompanying water vapor content within its interior, impeding the oxidation/polymerization process of the liquid paint. This vacuum lid, therefore permits the grid, roller, and brush, to be left inside in the wet condition and, when air is evacuated, the equipment stays saturated for lengthy periods of time and is ready for immediate use.

An important object of the invention is that the lid may be utilized with conventional thermoplastic containers. In this country paint is normally marketed in 1, 2½, and 5 gallon containers, with 1 and 5 being more prevalent for professional painters. For the above reason, two embodiments are taught, the 2½ gallon size is for minor jobs, where a small roller under 7 inches (17.8 cm) in length is used, such as the so-called "trim rollers" or colloquially "slim jim", "weeny roller", etc. The preferred embodiment employs a 5 gallon container and the common 9 inch (22.9 cm) roller. Both lids include an O-ring seal that interfaces with the outwardly flanged lip of the container, and a pair of release tabs that snap over and grip the containers lip securely, but are easy to release by simultaneously pulling them away from the lip. The seal is made airtight when a vacuum is pulled within. A considerable advantage is realized in that this size of set-up is already commonly used without the lid and is readily available in the 2½ and 5 gallon capacity. Further, no modification of any sort is required when employed with this invention.

Another object of the invention is the use of a simple, easily understood, one-piece unitary valve. All that is necessary to accomplish and maintain the vacuum process is the utilization of this resilient valve. Barbs extending from the periphery of the body seal directly to the container lid and its resilient nature provide a leak-tight interface with the pump. A pair of integral sealing lips provide the valve means and the vacuum within is easily released by simply pinching the lips transversely. Operation of the valve is intuitively obvious and indica is molded into the upper surface indicating the sides to be pressed together.

Still another object of the invention is that the lid and valve will function with most hand-held pumps without modification. Where the connector is threaded, an adapter may be used to convert the interface to a flat surface of a diameter compatible with the valve. Further, any mechanical motor driven vacuum pump may be used, preferably the oil-less type, such as a piston, vane, or diaphragm pump, with a hose attached, and a mating adapter. Since only a partial vacuum is pulled on the container, until it begins to collapse, small pumps capable of low vacuum, such as 25 inches (63.5 cm) of mercury will operate satisfactorily with as little as 1 cubic feet per minute (28.3 cfm) displacement.

Yet another object of the invention is directed to the lid's easy removal from the container, as separate lifting tabs are included. Conventional 2½ and 5 gallon plastic paint containers use flat lids that tightly snap over the upper lip to create an airtight seal. While this seal is very functional, it is difficult to remove, requiring a tool, or pulling separate sections by hand until it finally comes loose. The invention employs only a pair of opposed tabs that are easily lifted up, and since the O-ring seal is just resting on the lip after the vacuum is released, the lid is quickly and easily removed.

These and other objects and advantages of the present invention will become apparent from the subsequent detailed description of the preferred and other embodiments, also the appended claims, further taken in conjunction with the accompanying drawings.

BEST MODE FOR CARRYING OUT THE INVENTION

The best mode for carrying out the invention is presented in terms of a preferred and second embodiment.

Both embodiments are primarily designed alike, except the second embodiment is slightly smaller for use with a 2½ gallon container, and a raised rectangular rib is added to accommodate a roller inside.

Figure 1:
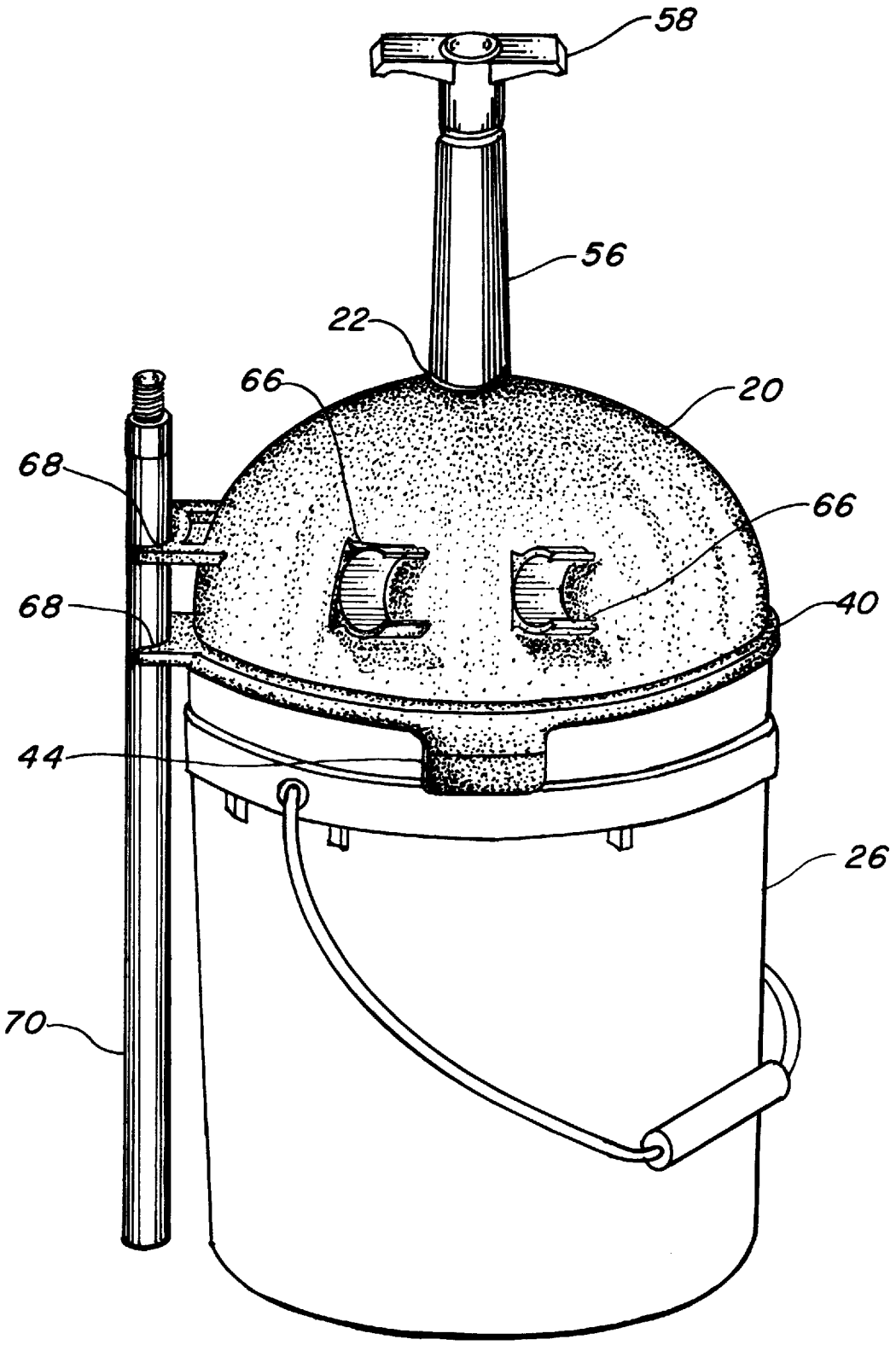
FIG. 1 is a partial isometric view of the preferred embodiment of the domed lid, including a plastic container with the pump attached to the valve.
Figure 2:
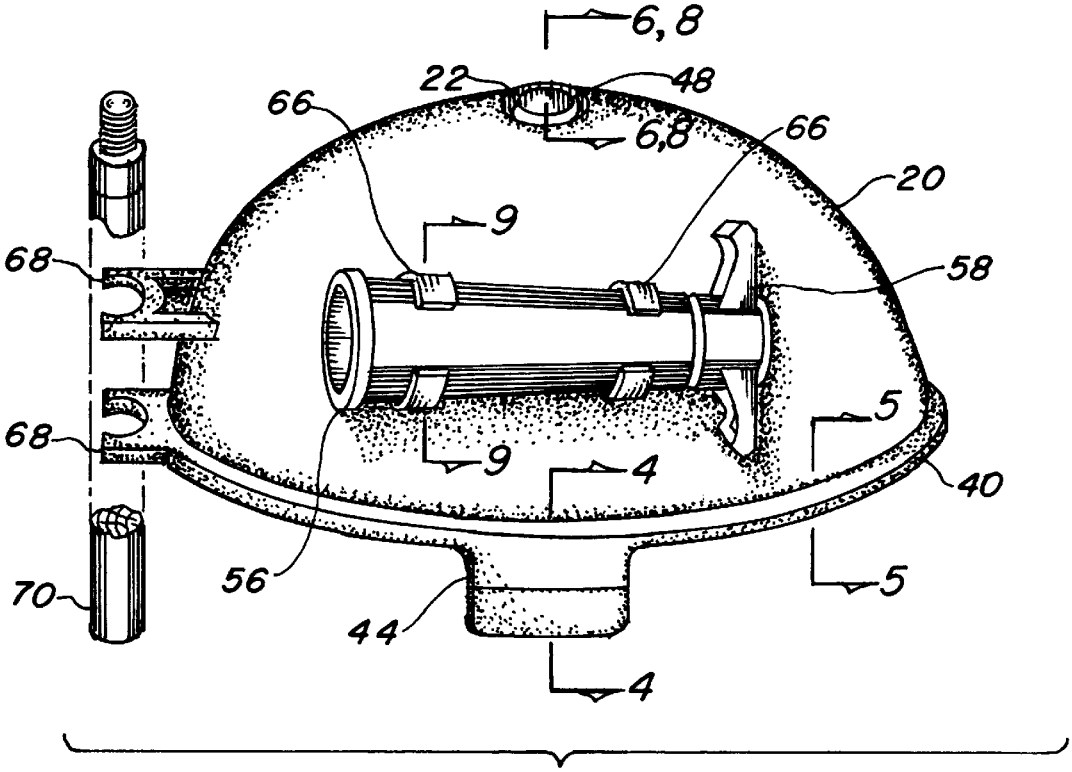
FIG. 2 is a partial isometric view of the preferred embodiment with the pump and handle extention installed in the storage means.
Figure 3:
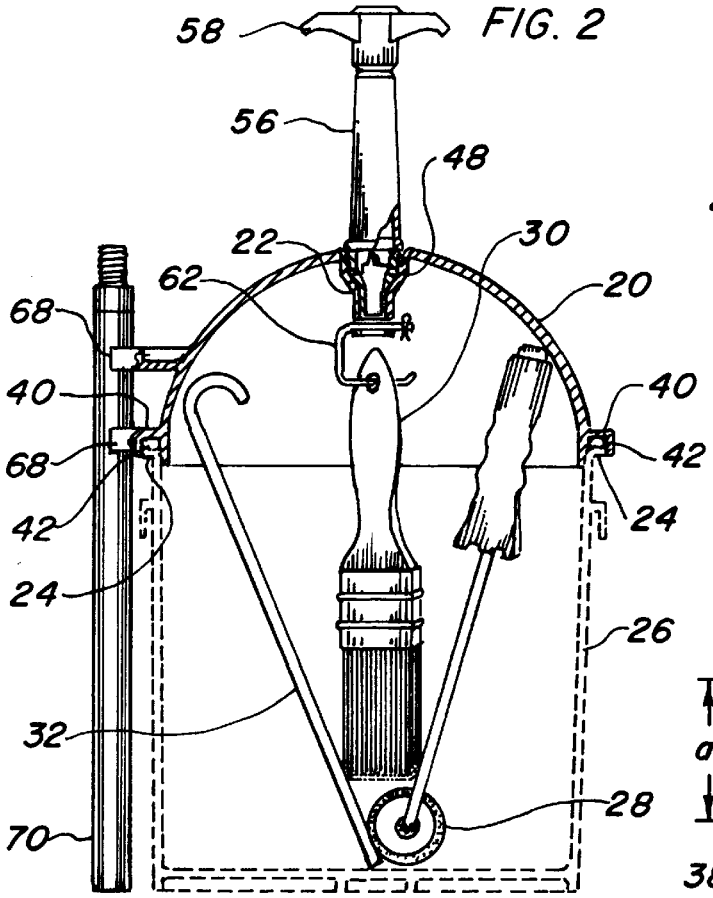
FIG. 3 is a cross-sectional view taken along the centerline with the container dotted and the pump in place.

The preferred embodiment, as shown in FIGS. 1 through 12, is comprised of a domed lid 20 with a recessed valve cavity 22 in the top, preferably in the center. The lid 20 is elliptical in shape, as shown in FIGS. 1 through 3, and interfaces with the top lip 24 of a round thermoplastic 5 gallon paint container 26 to form an airtight cover. The lid 20 is constructed of injection molded thermoplastic of the same basic compounds as the container 26. The lid 20 is domed tall enough to house painting implements inside the container 26, such as a conventional paint roller 28, a brush 30, and a bucket grid 32, as depicted in FIG. 3. The combination of tools and container is known in the industry as a set-up, allowing a painter to have all of the necessary equipment at hand for convenient application of paint. The height of the dome is governed by its diameter and the length of the tools, also hand clearance for the container bail and handle when it is rotated on top for carrying, therefore, an elliptical shape is preferred, which may accommodate both the conventional 5 gallon and 2½ gallon containers.

Figure 6:
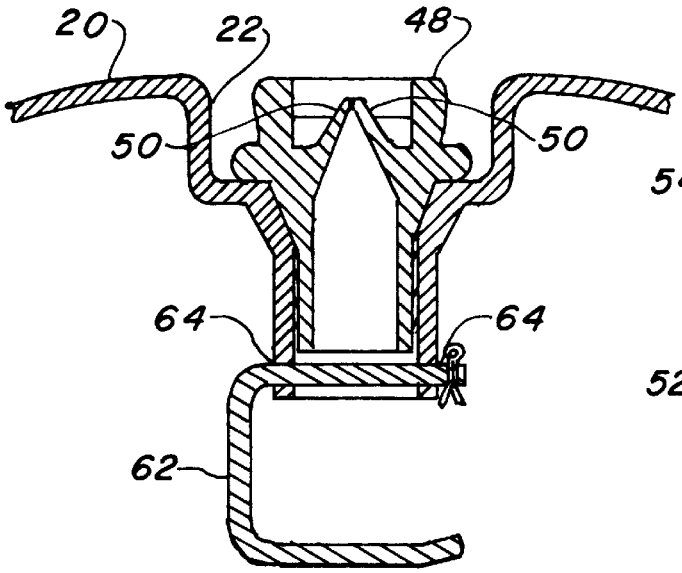
FIG. 6 is a cross-sectional view taken along lines 6—6 of FIG. 2 in the preferred embodiment with the valve and hook in place.
Figure 8:
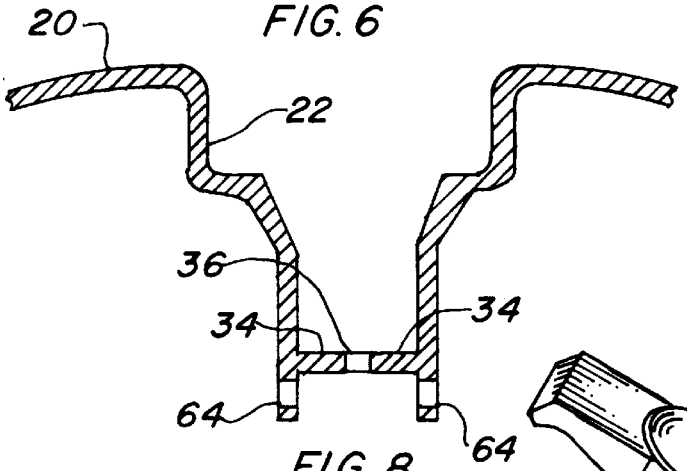
FIG. 8 is a cross-sectional view taken along lines 8—8 of FIG. 2 showing the recessed valve cavity having an orifice therein.

The recessed valve cavity 22 has an open bottom, as shown in FIGS. 3 and 6, however in another variation, the cavity may include a bottom 34 with an orifice 36 penetrating completely through, as illustrated in FIG. 8. Both embodiments function equally well, and other shapes and configurations may be incorporated with impunity.

Figure 4:
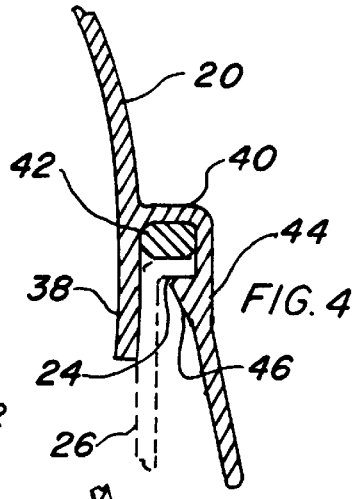
FIG. 4 is a cross-sectional view taken along lines 4—4 of FIG. 2 with the container shown in dotted lines.
Figure 5:
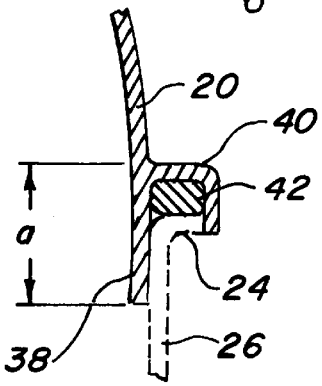
FIG. 5 is a cross-sectional view taken along lines 5—5 of FIG. 2 with the container shown in dotted lines.

The lid 20 incorporates a downwardly extending circumferential lip 38 that penetrates into the paint containers interior for convenience of alignment when installing the lid 20. FIGS. 4 and 5 illustrate this circumferential lip 38 in cross-section, further for convenience in application it is preferred that the lip 38 has a depth of from 0.125 inch (0.318 cm) to 0.500 inch (1.27 cm). The depth is shown in FIG. 5 and is designated "a" dimensionally.

An outwardly and downwardly extending peripheral flange 40, adjacent to the circumferential lip 38, forms a recess in between and in alignment with the paint containers top lip 24. The flange 40 extends downwardly, at least to the same plane as the bottom of the container top lip 24, as shown in FIG. 4. Within the cavity formed between the circumferential lip 38 and the peripheral flange 40, an O-ring 42 is located and held in place by its own inherent elastomeric tension. The O-ring 42 has a diameter that is at least as large as the top lip 24 of the container 26 and the recess between the circumferential lip 38 and flange 40. The O-ring 42 is made of soft resilient material that will compress into an airtight seal when drawn into contact with the containers top lip 24.

In order to initially hold the lid 20 onto the container 26, a number of lifting tabs 44 are integrally appended to the flange 40, as shown in FIGS. 1, 2, and 4. These tabs 44 include an inward finger 46 that springably engages the underside of the container's top lip 24. When the O-ring 42 is slightly compressed, a snap attachment is made between the lid 20 and the container 26, as the finger 46 rides over the top lip 24 and snaps into engagement, maintaining compression against the resilience of the soft O-ring material. When the lid 20 is to be removed, the tabs 44 are simultaneously disengaged by pulling outwardly until the finger 46 clears the top lip 24, freeing the lid from engagement. Preferably, two tabs 44 are utilized, however any number may be employed for better securement, if desired. Each tab 44 may be of any convenient width parallel with the flange 40, however it has been found that a width of from 0.50 inch (1.27 cm) to 2.00 inch (5.08 cm) permits one or two fingers to grip the tab 44 effectively and, therefore, is favored.

A valve 48 is secured within the recessed valve cavity 22, permitting a vacuum to be drawn within the covered container 26. The valve 48 functions to permit air to be withdrawn, and yet seals the negative pressure within the covered paint container, permitting a partial vacuum to be maintained within. The valve 48 is fabricated in one piece, therefore is of a unitary construction and is made of a resilient material, such as synthetic, or natural rubber, or pliable thermoplastic.

Figure 7:
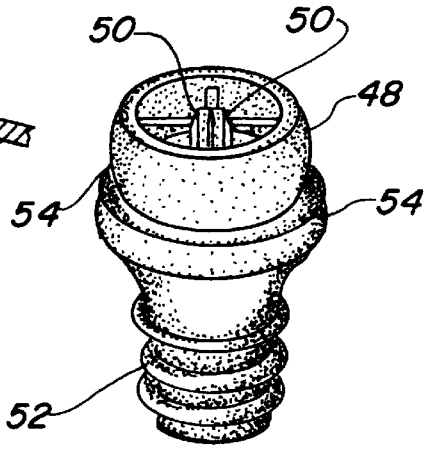
FIG. 7 is a partial isometric view of the valve completely removed from the invention for clarity.

The valve 48 best suited for the application and commercially available, as depicted in FIGS. 3, 6, and 7, is manufactured by Vacu Products B.V. in Al Delft, Holland and marketed under the registered trademark VACU-VIN. This particular valve is protected by numerous domestic and foreign utility and design patents, including 0234607, 4763803, 4911314, 1245195, 577438, 577719, 43120, 642/89, 365/89, D296522, and D296524. The valve 48 employs a pair of sealing lips 50, illustrated in FIG. 6, that open when air is drawn from the container's interior and close and seal when a vacuum remains within. Further, a number of sealing barbs 52 on the outer surface grip and seal between the valve 48 and the recessed valve cavity 22 within the lid 20. A radial seal 54 on the outer flanged surface interfaces with a vacuum source, and its inherent resilience creates the necessary seal. While the above valve 48 is shown and described, other valves may also be used, provided they include the same functional properties.

Figure 11:
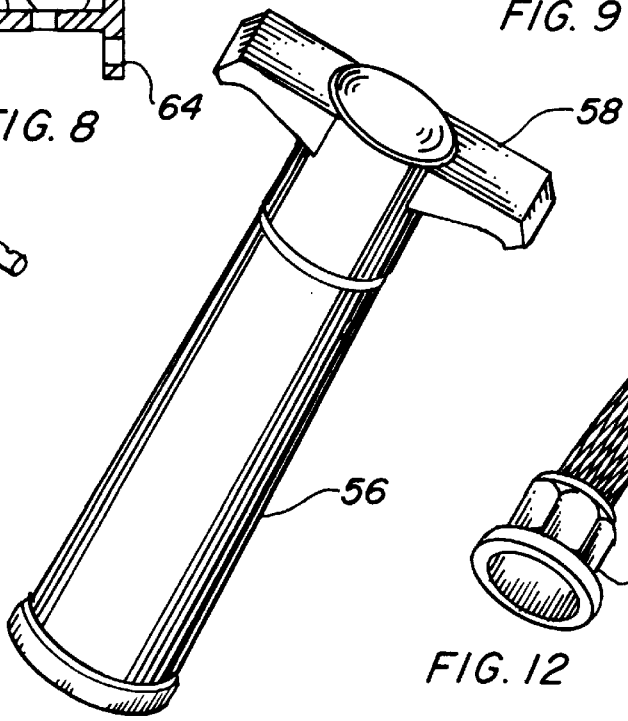
FIG. 11 is a partial isometric view of the hand pump by itself.

Vacuum pump means, preferably in the form of a hand-held manual pump 56, shown in FIGS. 1, 2 and 11, are removably attachable to the valve 48 for drawing air from the container 26 to prevent liquid paint stored within from desiccating or drying. The pump illustrated is manufactured by the same Vacu Products B.V. in Al Delft, Holland, however, a variety of hand-held pumps may be used with equal ease. The pump 56 utilizes a piston within a cylinder and a check valve. Pump action draws air upward into the pump when the handle 58 is withdrawn, ultimately depleting the quantity of air within the container 26. It has been found that reducing the pressure within the container to about 26.31 inches of mercury (66.8 cm) collapses the container walls, however, it is apparent that this amount of pressure reduction or partial vacuum is sufficient to prevent or, at least, delay the oxidation/polymerization process for long periods of time, certainly within the desired functional characteristics of the invention.

Figure 12:
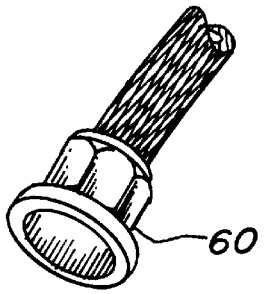
FIG. 12 is a partial isometric view of the vacuum pump means in the mechanical embodiment illustrating the adapter and hose less the pump.

While the hand-held pump 56 is the first choice, due to its portability and reasonable cost, other types of vacuum pumps may be utilized. Almost any type of mechanical pump may be used for evacuation, as long as it includes a suitable interfacing valve adapter 60, as shown in FIG. 12. Rotary vane, diaphragm, piston type vacuum pumps are readily available in the oil-free style rated for coarse vacuum, that is up to 28 inches (71.1 cm) of mercury. It should be noted that the oil-free type is advisable, as the oil mist lubrication in some fine and high vacuum pumps may contaminate the paint with small quantities of mineral based oil.

Figure 10:
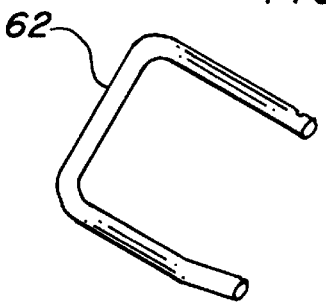
FIG. 10 is a partial isometric view of the C-shaped wireform hook completely removed from the invention for clarity.

Hook means permit the hanging of a wet brush 30 within the domed lid to prevent the bristles from being bent during storage. FIG. 3 illustrates a single hook 62, preferably made of a C-shaped wireform attached into the lid recessed valve cavity 22, as depicted in FIG. 6. This hook 62 is shown in FIG. 10 completely removed from the invention. While only one hook is illustrated penetrating a pair of holes 64 in the cavity 22, multiple hooks 62 may be used with equal ease interfacing with the lid 20 with brackets, or the like, permitting more than one brush 30 to be retained.

Figure 9:
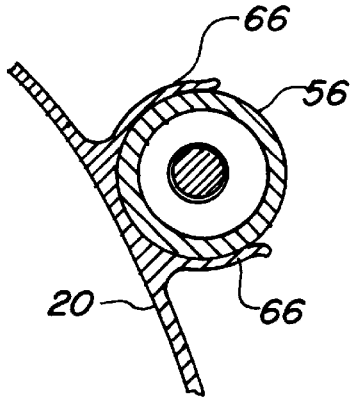
FIG. 9 is a cross-sectional view taken along lines 9—9 of FIG. 2 with the manual pump in place.

For convenience, vacuum pump storage means may be integrally formed into the external surface of the domed lid 20, as illustrated in FIGS. 1, 2 and 9, in the form of a pair of pump mounting brackets 66. These brackets 66 are configured to hold a manual vacuum pump 56 of the type illustrated in FIGS. 1 through 3, and 11, and are sized to permit a snap fit for retension, as the thermoplastic material of the lid has adequate resilience.

Another convenient appendage is the addition of handle extension storage means in the form of a pair of integral snap fit handle extension brackets 68, illustrated in FIGS. 2 and 3. These brackets 68 extend outwardly from the lids peripheral flange 40 and the dome itself. Again, the locking snap-in feature is the same as above. It will be noted that the handle extension 70 screws into the handle of the roller 28, and is well known in the art.

Figure 13:
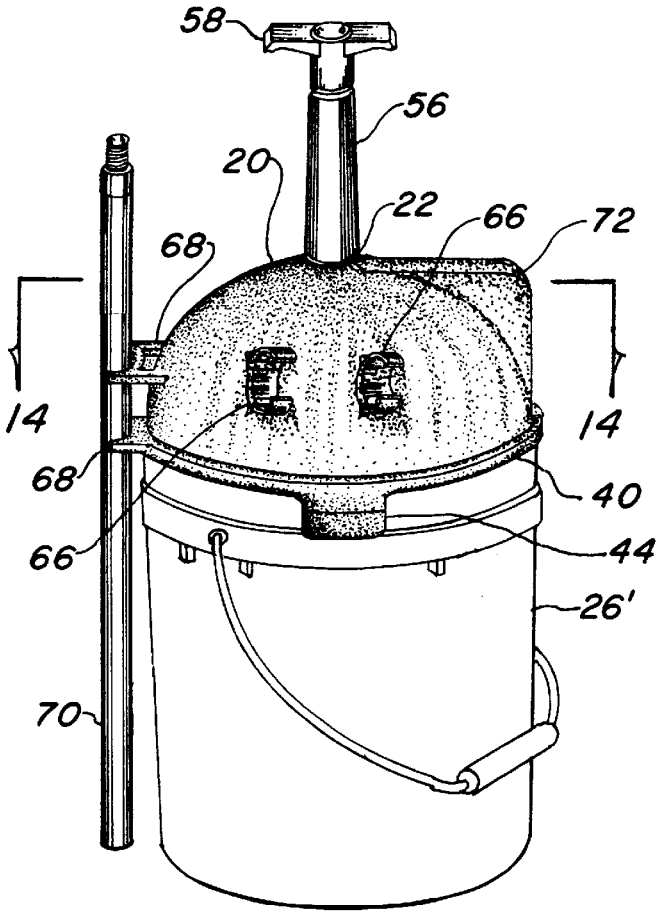
FIG. 13 is a partial isometric view of the second embodiment, including a 2½ gallon plastic container with the pump attached to the valve.
Figure 14:
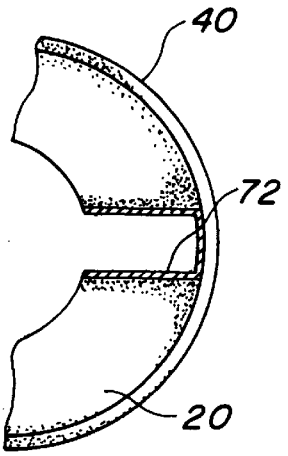
FIG. 14 is a cross-sectional view taken along lines 14—14 of FIG. 13 illustrating the raised rib.
Figure 15:
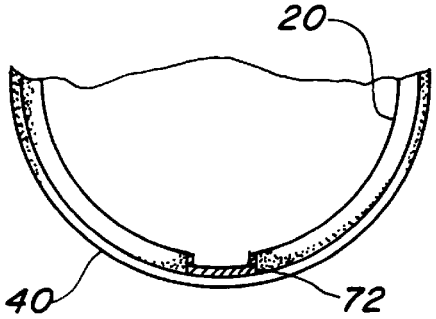
FIG. 15 is a cross-sectional view taken along lines 15—15 of FIG. 16 illustrating the raised rib.
Figure 16:
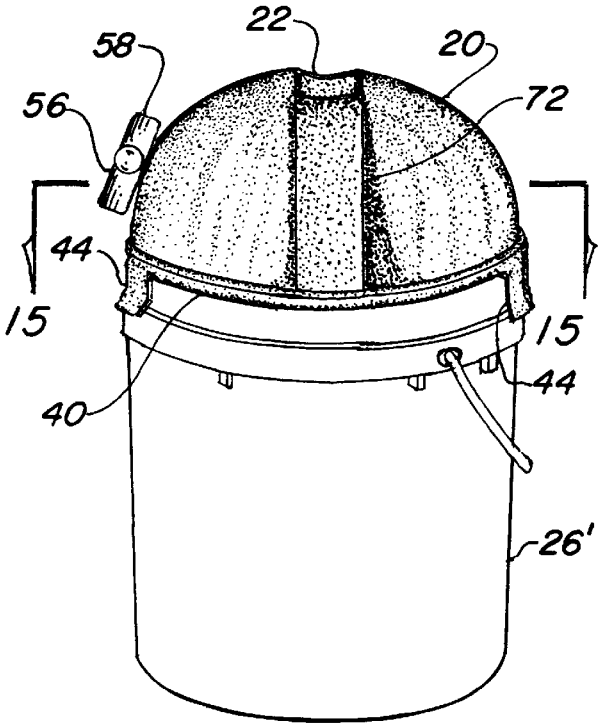
FIG. 16 is a partial isometric view of the second embodiment rotated 90 degrees from FIG. 13 less the pump.

The second embodiment, shown in FIGS. 13 through 16, is basically the same as the preferred embodiment, except it is specifically directed to a 2½ gallon container 26'. The 5 gallon container 26 and 2½ gallon container 26' are identical in features, except for their physical size. The 2½ gallon container, however, is too small to accommodate a roller 28, therefore, in this second embodiment, a raised rectangular rib 72 is added to the domed lid 20. This rib 72 extends horizontally outward from the lids center, as shown in FIG. 13, and has an internal span sufficiently wide to accept the handle of a paint roller 28. Only the small rollers 28, under 7 inches (17.8 cm) in width, fit within the 2½ gallon container 26', as previously discussed. The balance of this second embodiment is identical to the preferred embodiment.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A vacuum lid for a round thermoplastic paint container that includes a flat bottom and outwardly extending top lip comprising;

a domed lid, having a recessed valve cavity and a raised rectangular rib for contiguously engaging a top lip of a round thermoplastic paint container to form a protective airtight cover, a downwardly extending circumferential lip integral with the domed lid penetrating into a paint container interior for alignment when installing the lid thereupon, an outwardly and downwardly extending peripheral flange adjacent to the circumferential lip forming a recess therebetween in alignment with a paint container top lip for attachment thereupon, an o-ring disposed within the recess between the flange and the circumferintial lip for sealing the lid to a paint container when a vacuum is drawn therewithin, a plurality of lifting tabs integrally appended to the peripheral flange having an inward finger springably engaging an underside of a paint container top lip when the o-ring is compressed, creating a snap attachment between the lid and a paint container maintaining a mechanical grip until disengaged by manually urging the tabs outwardly to clear attaching interfaces, a valve sealingly disposed within the recessed valve cavity of the domed lid permitting a vacuum to be drawn therethrough while sealing negative pressure within a paint container covered by the domed lid, vacuum pump means removably attachable to the valve for drawing air from within a paint container covered by the lid to prevent liquid paint stored within from desiccating, wherein said unitary valve is one-piece unitary construction of a resilient material, and further comprises a pair of sealing lips that open when air is drawn through, and close and seal when a vacuum remains within, a plurality of sealing barbs for gripping and sealing between the valve and the recessed valve cavity in the domed lid, and a radial seal for interfacing with the vacuum pump means, and hook means within the domed lid interior for hanging, at least, one brush.

2. The vacuum lid as recited in claim 1 wherein said lid is constructed of injection molded thermoplastic.

3. The vacuum lid as recited in claim 1 wherein said domed lid is tall enough to house a roller cover and frame, along with a brush and bucket grid within a paint container to which the domed lid is attached.

4. The vacuum lid as recited in claim 1 wherein said domed lid is elliptical in shape.

5. The vacuum lid as recited in claim 1 wherein said recessed valve cavity within the domed lid further having a bottom with an orifice penetrating unobstructively therethrough.

6. The vacuum lid as recited in claim 1 wherein said downwardly extending circumferential lip has a depth of from 0.125 inch (0.318 cm) to 0.500 inch (1.27 cm).

7. The vacuum lid as recited in claim 1 wherein said O-ring has a diameter that is at least as large as the width of a paint container outwardly extending top lip to which the vacuum lid is fitted.

8. The vacuum lid as recited in claim 1 wherein said O-ring is of a soft resilient material.

9. The vacuum lid as recited in claim 1 wherein said lifting tab has a width parallel with the peripheral flange of from 0.50 inch (1.27 cm) to 2.00 inch (5.08 cm).

10. The vacuum lid as recited in claim 1 wherein said vacuum pump means further comprise a hand-held vacuum pump.

11. The vacuum lid as recited in claim 1 wherein said vacuum pump means further comprising a mechanical vacuum pump with an interfacing valve adapter.

12. The vacuum lid as recited in claim 1 wherein said hook means further comprising a C-shaped wireform attached to a portion of the lid which forms the recessed valve cavity.

13. The vacuum lid as recited in claim 1 further comprising vacuum pump storage means integrally formed into an external surface of the domed lid.

14. The vacuum lid as recited in claim 1 wherein said rectangular rib extends horizontally outward from the lids center and has an internal span sufficiently wide to accept a handle of a paint roller stored within a paint container having the lid attached thereto.

* * * * *